US005820210A

United States Patent [19]

Shipman et al.

[11] Patent Number: 5,820,210

[45] Date of Patent: Oct. 13, 1998

[54] STORAGE DEVICE FOR SEATING

[76] Inventors: Russell P. Shipman, 345 Fillmore St. #304, Denver, Colo. 80206; Mark S. Inboden, 1908 S. Leyden St., Denver, Colo. 80224

[21] Appl. No.: 862,110

[22] Filed: May 22, 1997

[51] Int. Cl.[6] ..... A47C 7/62

[52] U.S. Cl. ..... 297/188.01; 297/188.13; 297/188.2

[58] Field of Search ..... 297/188.1, 188.08, 297/188.09, 188.12, 188.01, 188.02, 188.13; 224/275

[56] References Cited

U.S. PATENT DOCUMENTS

| | | | |
|---|---|---|---|
| 180,127 | 5/1876 | Fritzerald | 297/188.13 |
| 308,700 | 12/1884 | Borden et al. . | |
| 628,605 | 7/1899 | Ottenheimer . | |
| 757,305 | 4/1904 | Henderson . | |
| 785,987 | 3/1905 | Van Nostran . | |
| 960,360 | 6/1910 | Lynch . | |
| 1,255,720 | 2/1918 | Ekman . | |
| 1,767,925 | 6/1930 | Hargreaves | 297/188.1 X |
| 3,589,661 | 6/1971 | Harris | 297/188.09 X |
| 4,783,120 | 11/1988 | Kiechlin | 297/188.2 X |
| 4,842,329 | 6/1989 | Owens | 297/188.2 X |
| 4,861,059 | 8/1989 | Shirk | 297/188.2 X |
| 5,573,288 | 11/1996 | Raffensperger | 297/188.12 |

FOREIGN PATENT DOCUMENTS

| | | | |
|---|---|---|---|
| 1171746 | 1/1959 | France . | |
| 1171746 A | 1/1959 | France | 297/188.13 |
| 174804 | 2/1922 | United Kingdom . | |

*Primary Examiner*—Peter M. Cuomo
*Assistant Examiner*—Stephen Vu
*Attorney, Agent, or Firm*—Dorr, Carson, Sloan & Birney, P.C.

[57] ABSTRACT

A storage device for attachment to chairs comprises a frame and a receptacle. The frame has a first part that is proximal to the chair when attached and a second part that is similar in shape to the first part and distal to the chair when attached. In a first embodiment, pegs extend from the inner face of the first part through the side edges of the receptacle and into sockets in the second part of the frame. The two parts of the frame are reversibly connected by conventional fasteners such as screws or bolts. In a second embodiment, detents extend from the inner face of the first part of the frame through the side edges of the receptacle. The detents are snapped into sockets placed in the second part of the frame, securely holding the two parts together. The detents allow the two parts of the frame to be pulled apart when desired, for example, to replace the receptacle. In both embodiments, a pocket is attached to the bottom of the receptacle and filled with advertising or marketing materials.

12 Claims, 6 Drawing Sheets

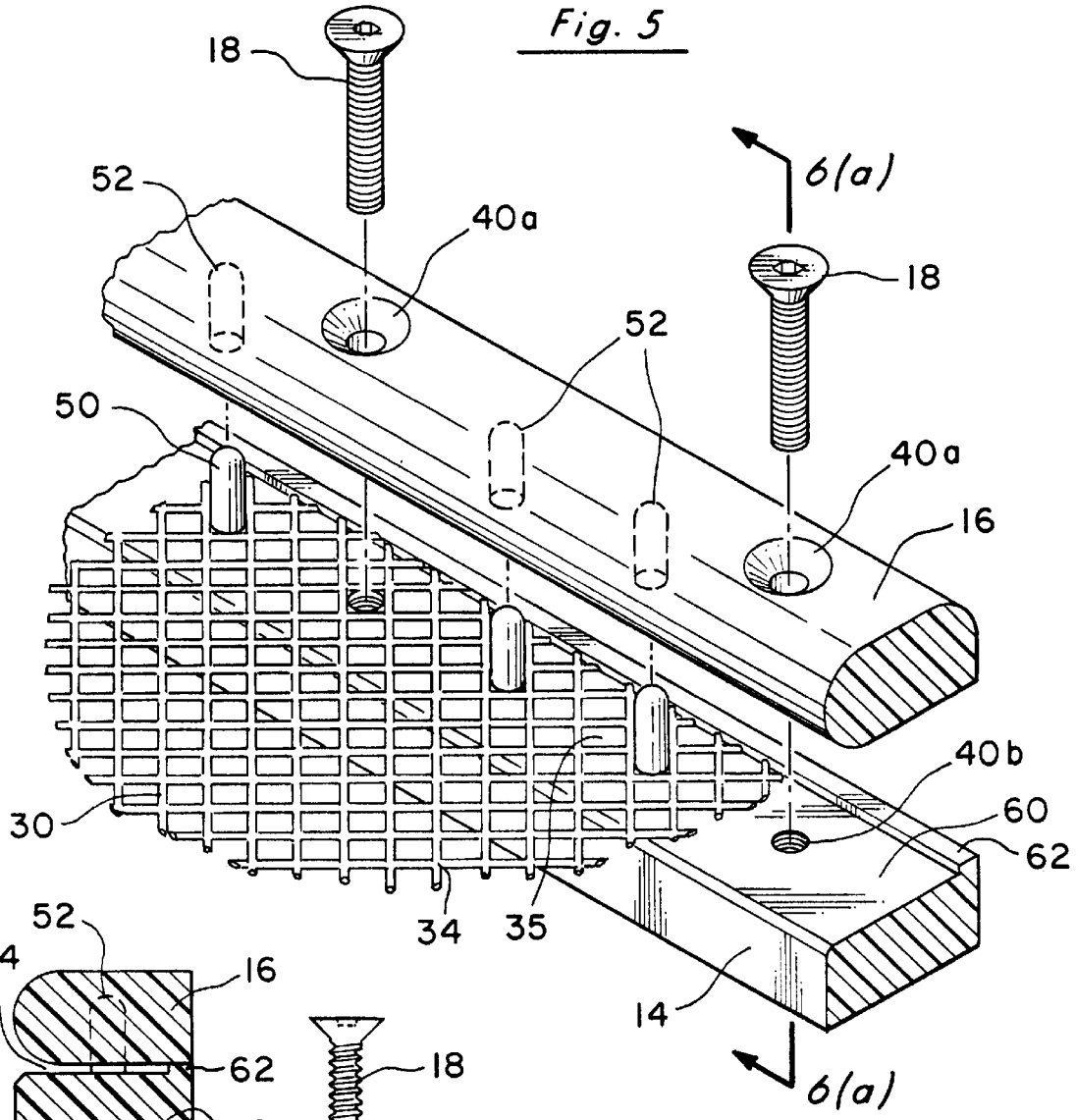
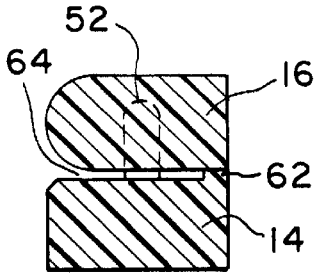
Fig. 6(c)
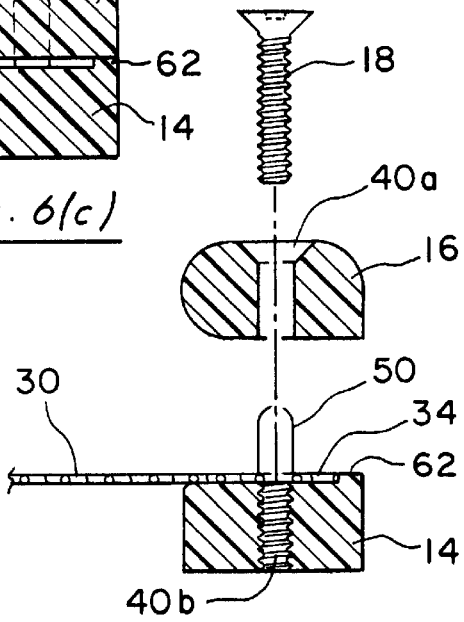
Fig. 6(a)
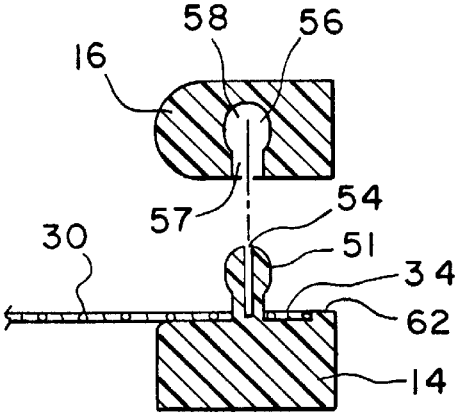
Fig. 6(b)

STORAGE DEVICE FOR SEATING

BACKGROUND OF THE INVENTION

1. Related filings

Disclosure Document No. 401926 was filed for the herein-described invention on Jul. 2, 1996.

2. Field of the Invention

The present invention relates generally to the field of storage devices. More specifically, the present invention discloses a storage device that can be attached to a seat or chair and in which the receptacle can be exchanged.

3. Statement of the Problem

When spectators attend an event held in an auditorium, theater, stadium, or other similar venue, they will often be carrying or wearing coats, sweaters, purses, or other items. In most such venues, the amount of seating is maximized by using rows of attached chairs with folding seats. The only places available under these circumstances to put coats, purses, or other items are on the chair, on one's lap or shoulders, or on the floor underneath the seat or in front of one's feet.

Holding coats on one's lap or over one's shoulders can be uncomfortable due to the warmth generated. Draping a coat over the chair and then sitting on the coat may be physically uncomfortable and can also lead to wrinkling of the item. Placing items on the floor is often undesirable because of the tendency for the floor to be dirty, and because of the potential for the item, if placed under the seat, to be forgotten or stolen by another person. Items placed in front of one's feet take up space that the person needs to use for their feet, may be crushed or dirtied if the person places his feet on them. Items placed in the aisle in front of the chairs also can be dangerous obstacles to those passing by or in a situation in which the auditorium or theater should need to be evacuated suddenly, as in the case of a fire or other emergency.

Thus, it would be desirable to provide storage devices that can be attached directly to a chair and in which the one could safely place one's belongings when using the seat. The most advantageous position in which to attach storage compartments to chairs with folding seats, such as those chairs that are often used in auditoriums and stadiums, would be attached to the bottom of the seat. Another area for attachment of storage compartments to such chairs would be to the back of the chair. Such storage compartments would be most efficacious if able to expand when in use in order to hold items of various sizes and to deflate when empty in order to take up a minimum of space in the aisles through which people must pass.

Storage compartments for seats have used in the past, including the following:

| Inventor | Patent No. | Issue Date |
|---|---|---|
| Dieches | FR1,171,746 | Jan. 1959 |
| Ekman | 1,244,720 | Feb. 5, 1918 |
| Stone | GB174,804 | Feb. 9, 1922 |
| Henderson | 757,305 | Apr. 12, 1904 |
| Ottenheimer | 628,605 | July 11, 1899 |
| Lynch | 960,360 | June 7, 1910 |
| Rafferty et al. | 308,700 | Dec. 2, 1884 |
| Van Nostran | 785,987 | Mar. 28, 1905 |

French Patent No. 1,171,746 discloses a net bag attached to the underside of a folding seat for receiving clothing items and hats. The bag is attached to the bottom of the seat with a U-shaped metal frame. The frame is inserted through the meshes of the netting.

British Patent No. 174,804 discloses an expandable fabric bag, generally square in shape. At the top of the bag, a rod or strip is threaded through a sleeve. The bag is attached to the underside of a folding seat by two handles in the back and a hook-and-eye in the front that enables the front of the bag to be released.

U.S. Pat. No. 1,255,720 teaches a theater seat hat rack made of flexible chains with wire rings acting as spacers to form a basket shape. The rack is attached to the seat bottom by spring-loaded flexible metal arms such that the front of the rack can be pulled down to insert the hat. When the front is released, the rack swings back up against the seat, supporting the hat. When the seat is raised, the rack "deflates."

U.S. Pat. No. 757,305 discloses a hat receptacle attached to an auditorium seat. The receptacle is attached to the underside of the seat with a rectangular metal frame. A rigid bottom piece is connected to the frame by flexible side and back webs. The rigid bottom is also enfolded by a web piece. Folding metallic arms may be used to brace the side webs if desired. When the seat bottom is folded up, the rigid bottom piece is folded up toward the seat, collapsing the side and back webs. The rigid bottom is held in place when folded by a catch on the front of the rectangular metal frame.

U.S. Pat. No. 628,605 discloses a hat-holding attachment for folding chairs. In this invention, a rigid bottom piece is attached to accordion-pleated side and back panels. The tops of the pleated panels are attached to a rectangular frame that extends outward from the bottom of the seat, forming a shallow box. When the attachment is folded into the box against the upright seat bottom, it is latched to the frame by a pivoting latching mechanism.

U.S. Pat. No. 960,360 discloses a collapsible receptacle that is attached to the undersides of the seats of folding or theater chairs. The receptacle comprises an attaching plate that is fastened to the underside of the seat and to which is attached a stiff bottom with flexible material forming the sides. The flexible material, which may be netting, extends around the sides and back of the receptacle. The bottom extends away from the top plate by spring-loaded U-shaped members that travel around the sides and back of the receptacle, and that cross each other at the sides, forming an X shape. One U-shaped member is hinged to the seat while the other is hinged to the bottom of the receptacle. A wire hat holder is attached to the underside of the bottom piece of the receptacle to hold a hat in an inverted position.

U.S. Pat. No. 308,700 teaches an opera chair having attached to the bottom of its seat a folding shelf with open sides and back. The shelf is attached to the seat by a plurality of pivoting members, enabling the shelf to automatically extend and retract as the seat is lowered and raised.

Replacement of the storage receptacle is necessary when the receptacle becomes worn or is damaged. Replacement is also necessary when a different type of receptacle is needed or desired, for example, to replace a smaller receptacle with a larger receptacle, or to replace a receptacle made of one type of material, such as a mesh, with a receptacle made of another type of material, such as canvas. Although the above references disclose several types of storage compartments that are attached to seats and are collapsible, none of these patents show a storage device for seats in which the storage receptacle can be easily replaced without removing the entire frame from the seat.

The owners of venues such as stadiums, auditoriums, theaters, etc., in addition to providing their customers with storage for their belongings, are often interested in providing advertising opportunities for others. However, because of the closely packed seating that is usually found in these venues, and because of the necessity for providing a reasonably unobstructed viewing path for all the spectators in the venue, the available space for placing advertising materials is limited. In addition, if advertisements are placed on the available support structures of the venue, or are displayed on a large-screen motion picture sign, the ads will often be too distant for many of the attendees to see unless the ads are extremely large. Use of large ads reduces the number of ads that can be displayed. Thus, it is desirable to place advertisements in the venue in a multitude of locations and available for many of the patrons to view, without taking up a large amount of space.

U.S. Pat. No. 785,987 discloses an attachment for the backs of theater seats. The attachment comprises a flat plate that is hinged in the middle so as to fold up and down into open and closed positions. A swiveling coat hook is attached to the bottom of the flat plate. The inner faces of the hinged plate are respectively provided with a mirror and a card printed with an advertisement. When the plate is opened, the mirror is found in the topmost section and the advertisement is found in the bottom section. The advertising card is held in place by the rolled sides of the bottom section of the plate. Because the user must physically open the plate in order to see the advertisement, the ad is not visible to the casual viewer or passerby at all times. Furthermore, because the plate is attached to the backs of the seats, when the plate is open only a few people who are sitting directly behind or to the side of the attachment will be able to view the ad It would be desirable to develop a system in which many ads could be placed in multiple locations, such as on the seats, throughout a venue and be constantly visible to most of the people who attend an event without effort on their part. Such a system would be most advantageous if the ads could be easily interchanged.

SUMMARY OF THE INVENTION

This invention provides a storage device for use with event seating that securely holds a receptacle yet is easily taken apart when the receptacle must be replaced or removed. The storage device can be attached to various locations on chairs, and is preferably attached to the underside of a folding seat. Further, the storage device comprises a pocket in which advertisements or other marketing materials may be placed.

The storage device of the present invention comprises a frame and a flexible receptacle. The frame is generally U-shaped and has a first part and a second part. When the storage device is attached to a chair, the first part is proximal to the chair and the second part is distal to the chair.

The receptacle is preferably made of a strong and flexible material, for example, netting. Such netting is weather resistant for use in outdoor venues. The flexibility of the netting enables the receptacle to expand during use and to collapse out of the way when not being used. It is to be understood that other types of material can be used for the receptacle, and that this invention is not meant to be limited by the particular description found herein.

In a first embodiment of the present invention, a plurality of pegs extend from the inner surface of the first part of the frame. Corresponding sockets for the pegs are drilled into the second part of the frame. Holes for connectors are placed in both the first and second parts of the frame. When the storage device is assembled, the side edges of the receptacle are inserted between the two parts of the frame. For receptacles made of netting, the mesh spaces of the netting are hooked over pegs that extend from the first part of the frame. For receptacles made of other materials, reinforced spaces are cut into the material, and the pegs are inserted into the spaces. The first and the second parts of the frame are then juxtaposed and attached together with conventional fasteners such as, for example, screws or bolts. The fasteners also pass through the spaces in the edges of the receptacle, providing additional attachment for the receptacle. The conventional fasteners are easily removable so that the frame can be disassembled when needed, for example, to replace a damaged or worn receptacle or to change a receptacle made of one type of material with a receptacle made of a different type of material.

In a second preferred embodiment of the present invention, conventional fasteners are not used to connect the two parts of the frame. Instead, in addition to the pegs, a plurality of detents extend from the inner surface of the first part of the frame. The detents are generally bulb-shaped, with a narrow neck and a rounded head. A slot is cut into the head and neck of the detent so that the detent is compressible. Sockets with narrow shafts and enlarged seats corresponding to the shape of the detents are set into the second part of the frame.

When the storage device is assembled, the edges of the receptacle are placed over the pegs and the detents so that the pegs and detents extend through the spaces in the edges. The detents are then snapped into their corresponding shaped sockets, the slot allowing each detent to compress as it passes through the narrow shaft of the socket and return to its standard shape when the head of the detent enters the enlarged seat of the socket.

When the second embodiment of the storage device needs to be disassembled for any reason, the two parts of the frame can be separated by simply pulling on the second part of the frame, thus pulling the detents out of their sockets.

In both embodiments, when the storage device is assembled, it is attached to a chair by conventional fasteners, for example, screws or bolts. The receptacle is thus enclosed on all sides while the front of the receptacle remains open. In the preferred embodiments, the front edge of the receptacle is reinforced with a strong material that contains an elastic band. The elastic band serves to secure items within the receptacle.

The device is preferably attached to the underside of the seat of a folding chair. In this position, when the seat is folded up, the flexible receptacle collapses and flattens, thus staying out of the way of passers-by. When the seat is opened, the receptacle hangs down, ready to receive coats, purses, or other items. Alternatively, the storage device can be attached to the back or the side of a chair as desired by the circumstances of the venue.

The storage device of the present invention also provides a means for displaying advertising. In another embodiment of the invention, a pocket is attached by conventional means to the bottom of the receptacle. The pocket is preferably made of a clear material such as plastic. Advertisements or other marketing materials are inserted in the pocket so that they are visible through the clear material forming the pocket. When the storage device is attached to the underside of a folding seat, and the seat is in its folded position, the ad in the pocket is displayed through the clear pocket to those walking in front of that seat. The advertisements can be easily exchanged whenever desired, and many thousands of similar or different ads may thus be presented to the event spectators without any effort on their part.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 5 is an exploded sectional view of a portion of the frame and receptacle of the present invention.

FIG. 6*a* is a cross-sectional view of the frame of the present invention.

FIGS. 6*b* is a cross-sectional view of a second embodiment of the frame of the present invention.

FIG. 6*c* is a cross-sectional view of the present invention illustrating the positions of the first part of the frame and the second part of the frame when attached.

DETAILED DESCRIPTION OF THE INVENTION

Figure 1:
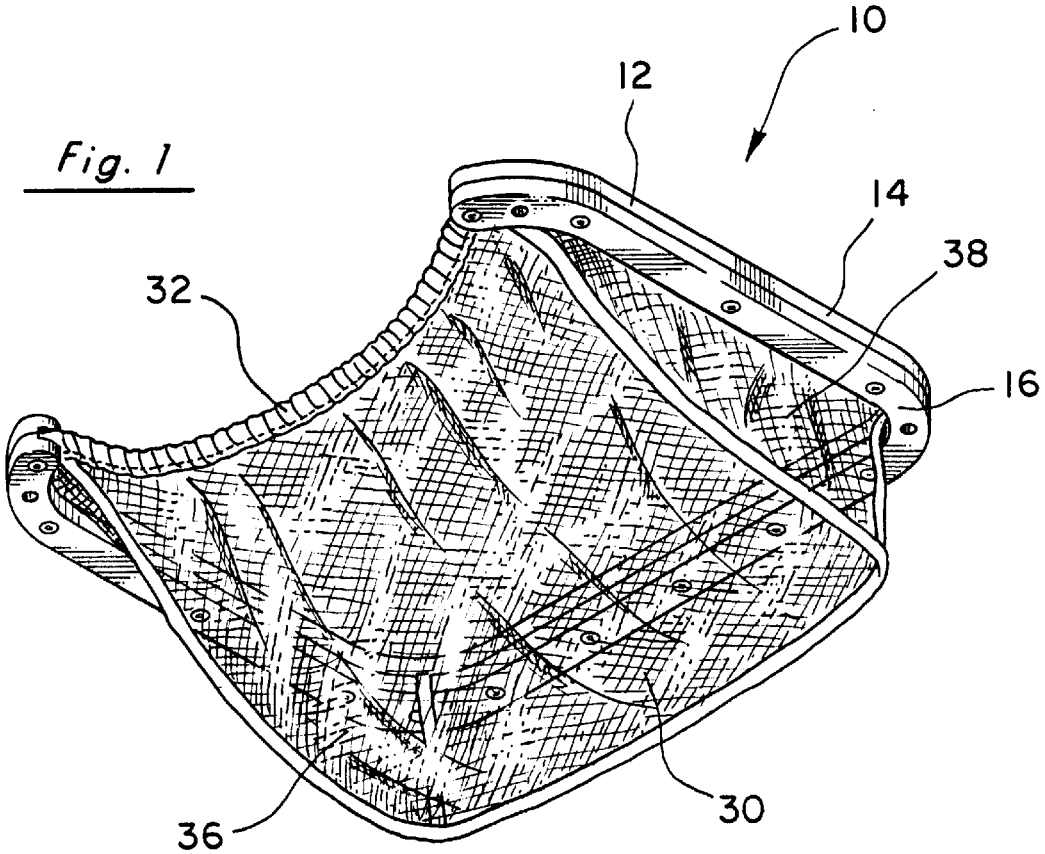
FIG. 1 is a perspective view of the present invention.

FIGS. 1 through 4 depict the storage device 10 that is attached to a chair according to the teachings of the present invention. The storage device 10 comprises a frame 12 to which is attached a flexible receptacle 30. The frame 12 is attached securely to a chair, by which attachment the receptacle 30 is positioned to receive any items that the user of the chair might wish to store.

The frame 12 has two parts, a first part 14 and a second part 16. The frame 12 is preferably made of a high-impact, lightweight plastic by injection molding. The two parts 14, 16 are, in one preferred embodiment, largely U-shaped, as can be seen most easily in FIGS. 3 and 4. It should be understood, however, that additional embodiments of the present invention may comprise other frame shapes, such as a rectangular shape or a circular shape, and that such other shapes are contemplated under the teachings of the present invention.

Figure 2:
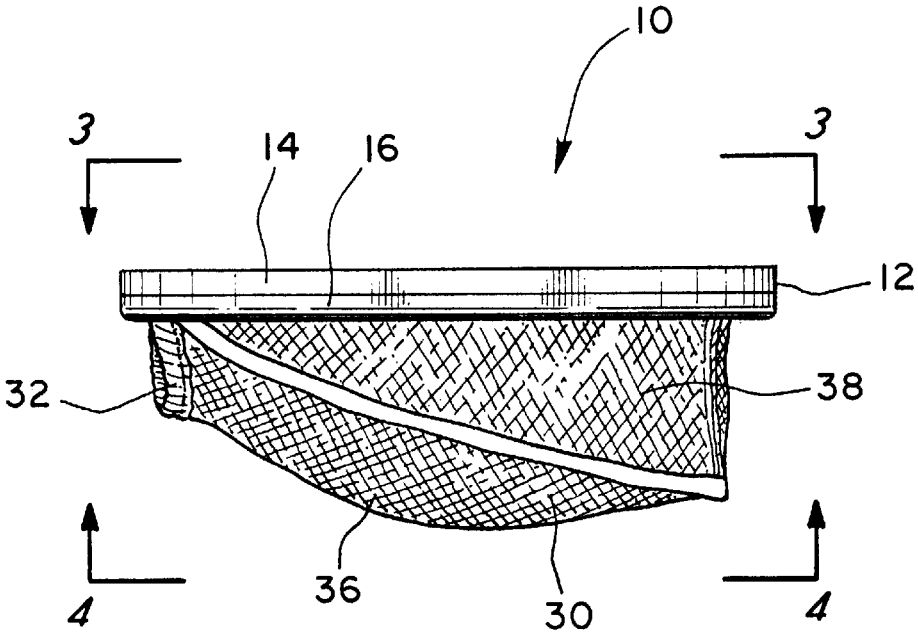
FIG. 2 is a left side view of the present invention (the right side view is a mirror image of the left side view).
Figure 3:
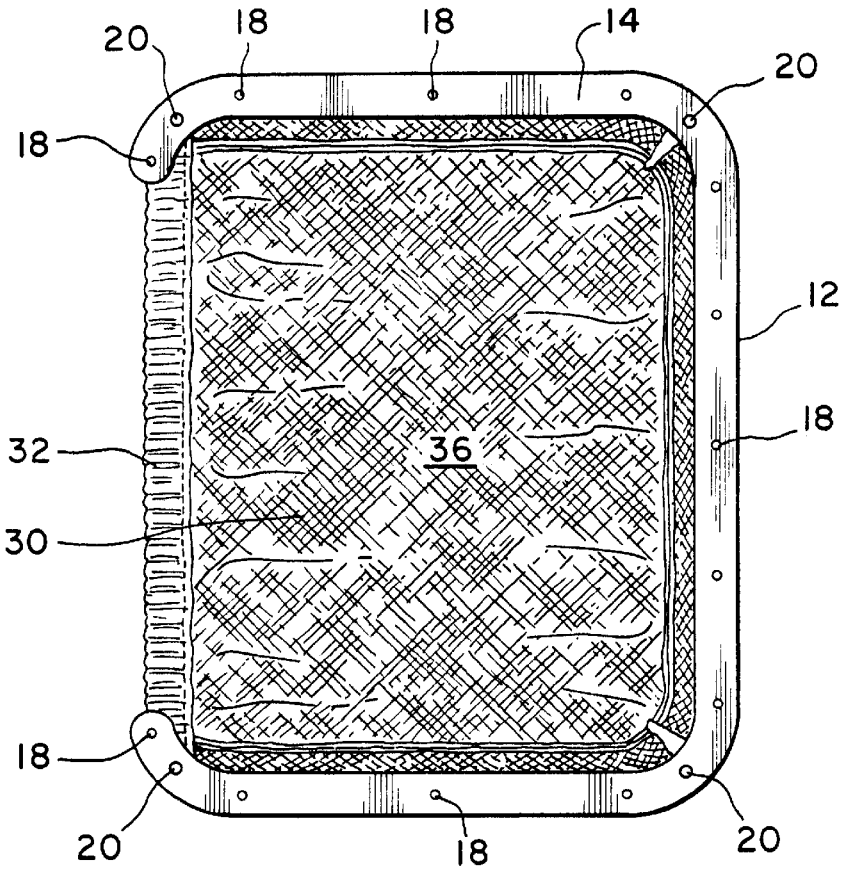
FIG. 3 is a top view of the present invention.
Figure 4:
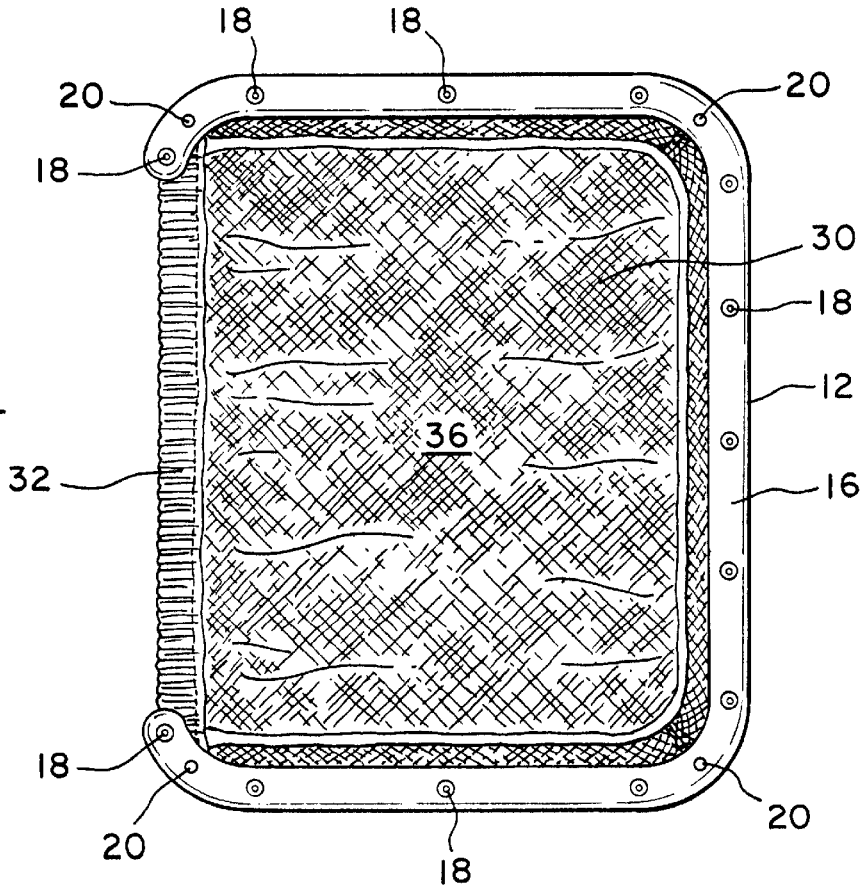
FIG. 4 is a bottom view of the present invention.

When the frame 12 is assembled, the first part 14 of the frame 12 is closely juxtaposed to the second part 16 of the frame 12, as can be seen in FIG. 2. This provides the frame 12 with a low profile after it is attached to a chair, which is of advantage when the storage device is used in a high-density seating application. The receptacle 30 is secured between the first part 14 and the second part 16 of the frame 12.

As shown in FIGS. 1 through 4, a flexible material is used to form the receptacle 30. In the preferred embodiment, a strong mesh netting has been found to be advantageous for this purpose. Such a netting has the advantages of light weight, water and UV resistance for outdoor applications, and breathability. It is to be understood, however, that other materials may be used for the receptacle 30, depending on the circumstances under which the storage device is to be used. For example, to avoid snagging of a mesh material, a canvas or other durable fabric could be used for the receptacle.

In the preferred embodiment of the storage device 10, the receptacle 30 has an open front 32 and side edges 34 (as shown in FIG. 5) that are attached securely to the frame 12. When the receptacle 30 is made of a material other than netting, in which the meshes provide holes for mounting the receptacle 30 to the frame 12, spaces 35 are cut into the side edges (not shown) and reinforced to enable the attachment of the receptacle 30 to the frame 12. The front 32 is reinforced with a strong material to prevent tearing. The reinforcing material houses an elastic band that acts to hold the front 32 of the receptacle 30 closed when it is in use so that any items placed within the receptacle 30 are held securely until removed. The receptacle 30 as illustrated in FIGS. 1 through 4 is formed of a bottom piece 36 and side pieces 38, forming a wedgelike shape that is narrower toward the front 32 and wider toward the rear. The seams of these pieces 36, 38 are also reinforced. It should be understood that although a preferred embodiment of a storage receptacle is herein disclosed, other forms of the receptacle 30 are contemplated under the present invention, and the receptacle 30 of the present invention is not meant to be limited by any particular descriptions of shape or materials found herein.

FIG. 5 shows the internal structure of a first preferred embodiment of the frame 12 of the storage device 10. The first part 14 of the frame 12, which is proximal to the chair when the storage device 10 is in use, is rectangular in cross section, and has on its inside face 60 a raised lip 62 on one edge. When the first part 14 is juxtaposed to the second part 16, as shown in FIG. 6*c*, the second part 16 is supported on the lip 62, leaving a narrow space 64 between the second part 16 and the inside face 60 of the first part 14. Extending from the inside face 60 of the first part 14 are a plurality of pegs 50.

The first part 14 of the frame 12 must be securely attached to the second part 16, and the receptacle 30 must also be attached to the frame 12. In the first preferred embodiment illustrated in FIGS. 5, 6*a*, and 6*c*, the first part 14 is attached to the second part 16 by connectors 18, for example, screws or bolts. Preferably, the connectors 18 are designed to be easily removed when it is desired to separate the first part 14 of the frame 12 from the second part 16, for example, for replacement of the receptacle 30.

A plurality of holes 40*a* are drilled through the second part 16 of the frame 12, with corresponding holes drilled through the first part 14. The holes 40*a* in the second part 16 are countersunk, as can be seen most easily in FIG. 6*a*, to accept the heads of the connectors 18 that are inserted through the holes 40*a* and 40*b* in order to connect the first part 14 of the frame 12 to the second part 16. Countersinking the heads of the connectors 18 gives the second part 16 a smooth outer surface after it is attached to the first part 14. This smooth surface prevents the heads of the connectors 18 from tearing or snagging the clothing or flesh of passers-by or the person who is seated in the chair.

When the frame 12 is assembled, the side edges 34 of the receptacle 30 are laid over the inside face 60 of the first part 14, with the pegs 50 extending through the spaces 35 in the side edges 34. When the connectors 18 are inserted through the holes 40*a,* 40*b* to attach the first part 14 to the second part 16, the connectors 18 also pass through the spaces 35 in the side edges 34 of the receptacle 30 (see FIG. 6*a* and 6*b*). As shown in FIG. 6*c,* when the first part 14 and the second part 16 are juxtaposed, the pegs 50 are inserted into sockets 52 that are partially drilled into the second part 16 of the frame 12. The pegs 50 thus provide additional attachment points for the receptacle 30, thus preventing gaps from occurring around the side edges 34 of the receptacle 30 when it is in use. The side edges 34 of the receptacle 30 lie within the space 64 formed when the first part 14 of the frame 12 is attached to the second part 16.

In a second and even more preferred embodiment illustrated in FIG. 6*b,* no connectors 18 are employed as in the first preferred embodiment. Instead, a plurality of detents 51 extend from the inner face 60 of the first part 14 in addition to the pegs 50. The detents 51 have enlarged, rounded heads with slots 54 cut into them. Similarly shaped sockets 56 having a narrow shaft 57 and an enlarged seat 58 are formed in corresponding locations in the second part 16.

When the storage device 10 of the second preferred embodiment is put together, the side edges 34 of the receptacle 30 are hooked over the detents 51 (and the pegs 50) as in the first preferred embodiment. The detents 51 are then inserted into their corresponding sockets 56 in the second part 16. The slots 56 allow the heads of the detents 51 to be compressed as the detents 51 enter the shafts 57 of the sockets 56. As the detents 51 reach the enlarged seat area 58, they reexpand to their open configuration, snapping into the sockets 56 and securely holding the two parts 14, 16 together. Thus, the need for separate connectors 18 is obviated. When it is desired to separate the first part 14 and the second part 16 of the frame 12 of the second preferred embodiment, one can easily pull apart the two parts 14 and 16, replace the receptacle 30, and snap the two parts 14, 16 together again.

In both of the preferred embodiments illustrated in FIGS. 5 and 6*b,* the second part 16 of the frame 12, which is distal to the chair, has a generally oval cross-section with rounded sides. When the storage device 10 is put together, the side edge 34 of the receptacle 30 abuts the rounded side of the second part 16. The rounded sides help to reduce wear on the material of the receptacle 30 when the receptacle 30 is being used.

Figure 7:
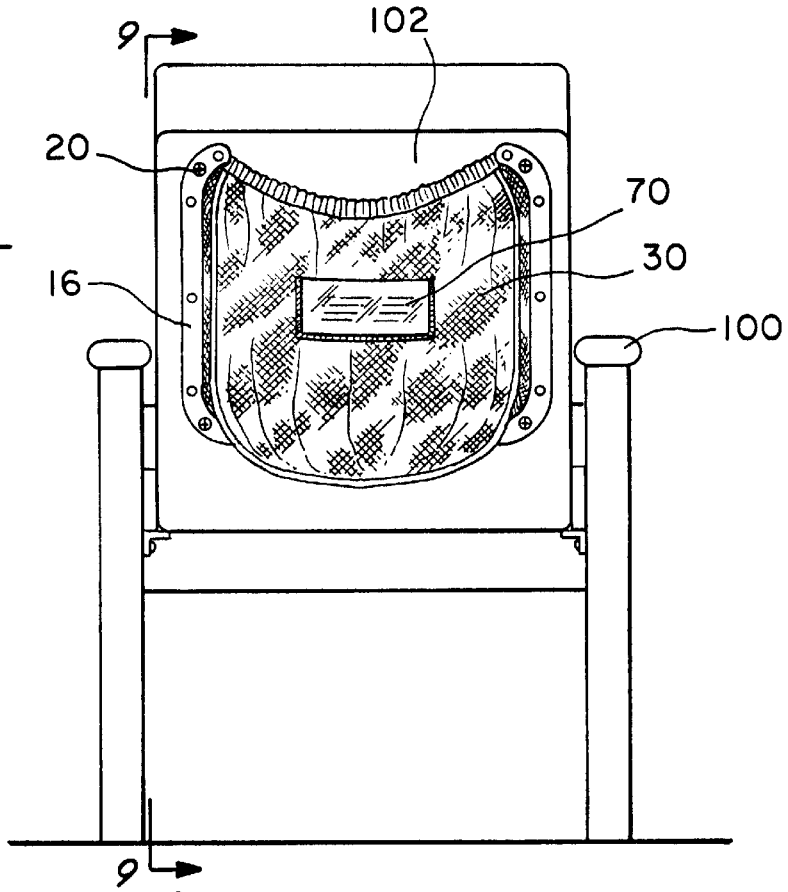
FIG. 7 is a front view of the present invention with an advertising pocket attached to the bottom of a seat, with the seat raised.
Figure 8:
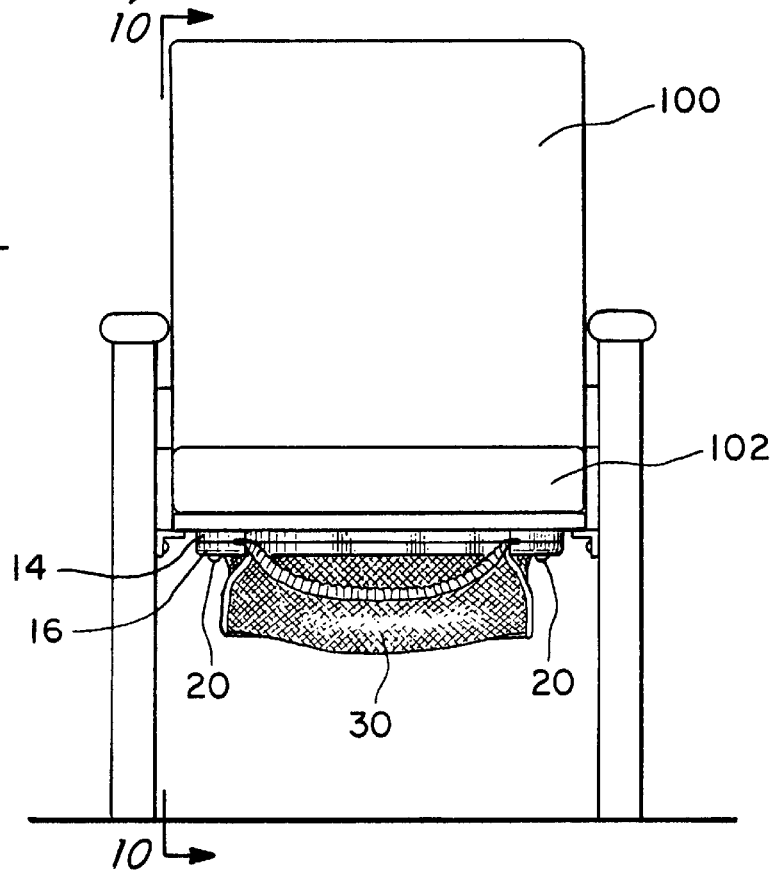
FIG. 8 is a front view as in FIG. 7 with the seat lowered.

FIGS. 7 through 12 show the storage device 10 of the present invention attached to various parts of a chair 100. In FIGS. 7 through 10, the storage device 10 is attached to the underside of a folding seat 102 by conventional fasteners such as, for example, screws 20 or bolts, that extend through both parts 14, 16 of the frame 12 and into the seat 102. Again, the heads of the fasteners 20 are countersunk into the frame 12, so that a smooth surface results. As can be seen in FIG. 8, when the storage device is attached to a chair, the first part 14 of the frame 12 is proximal to the chair 100, while the second part 16 of the frame 12 is distal to the chair 100.

Figure 9:
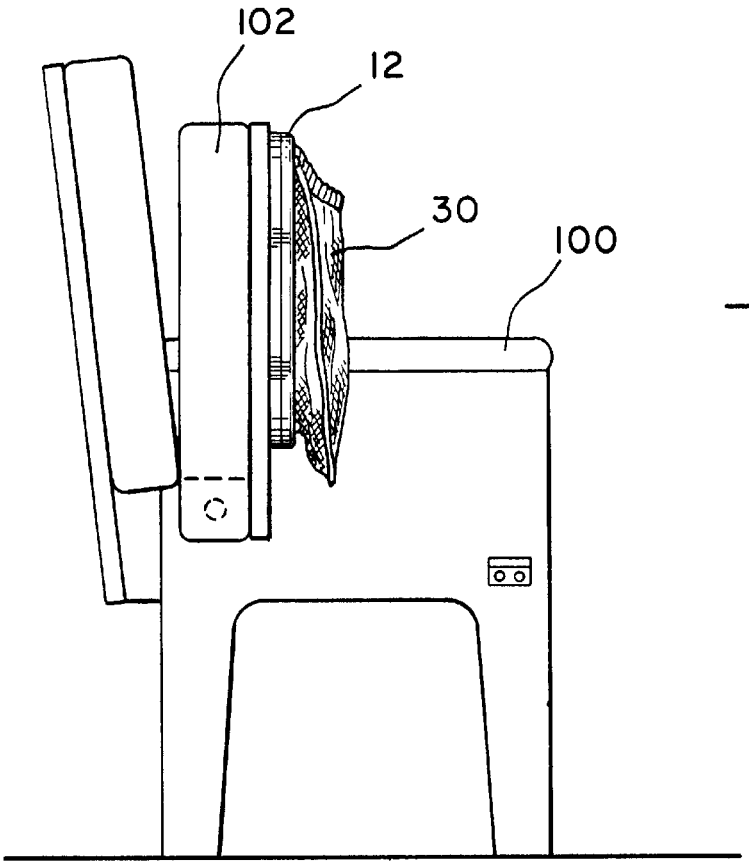
FIG. 9 is a cutaway side view of the chair of FIG. 7.
Figure 10:
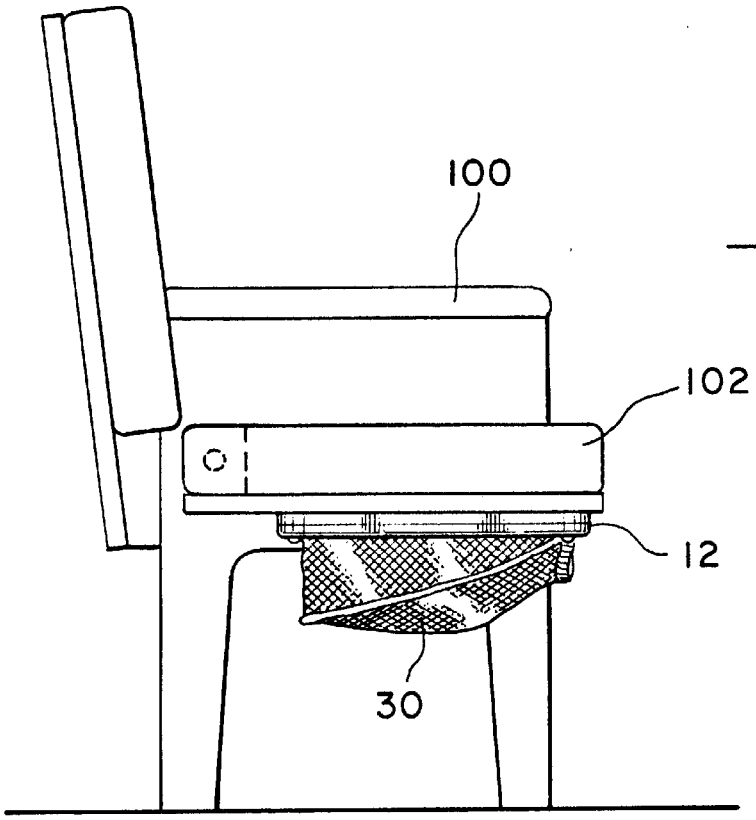
FIG. 10 is a cutaway side view of the chair of FIG. 8.
Figure 11:
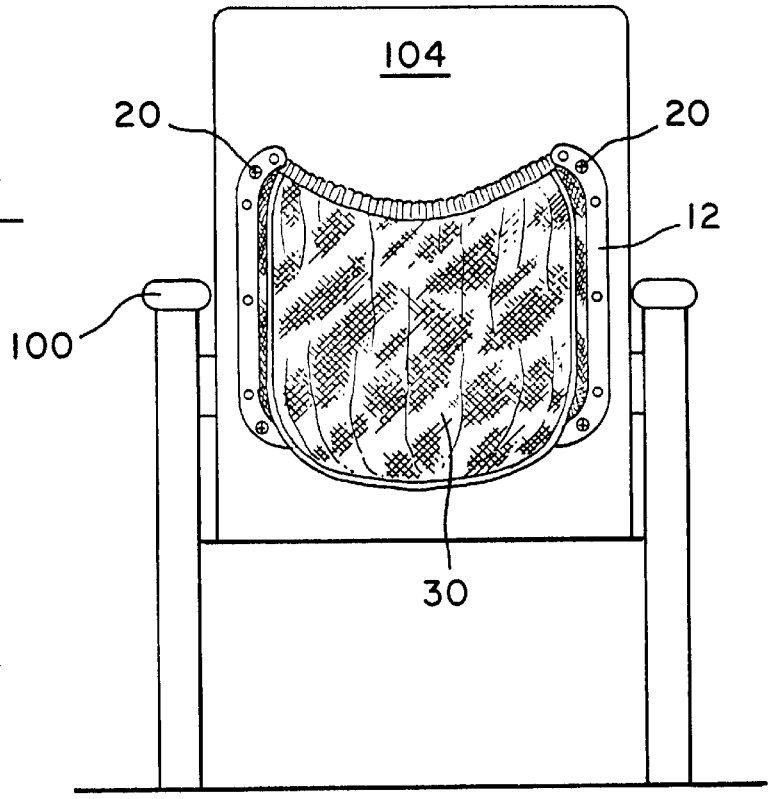
FIG. 11 is a back view of a chair with the present invention attached to the back of the chair.

When the folding seat 102 of the chair 100 is in a raised position, as illustrated in FIGS. 7 and 9, the receptacle 30, being made of a flexible material, collapses and thus remains well out of the way of spectators passing through the aisles in front of the chairs 100. When the folding seat 102 is put down, the receptacle 30 hangs open as shown in FIGS. 8 and 10, ready for use by the spectator.

Figure 12:
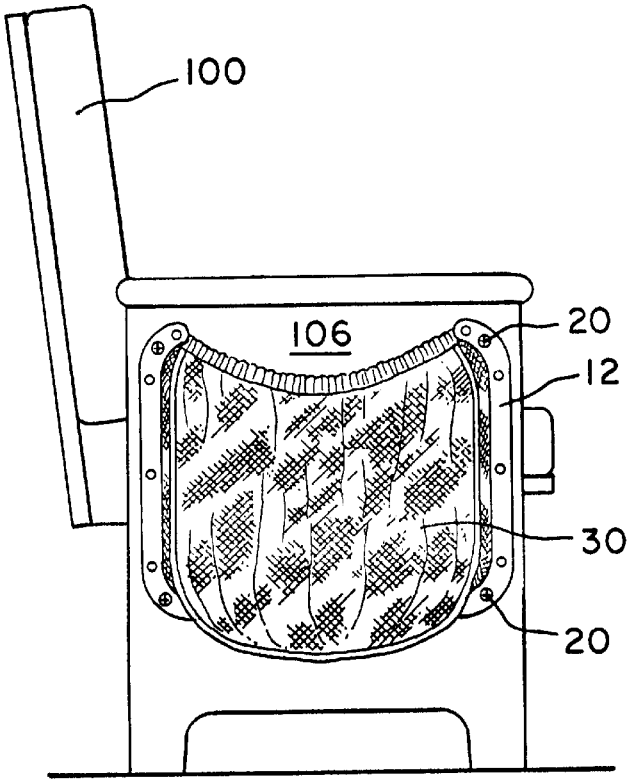
FIG. 12 is a side view of a chair with the present invention attached to the side of the chair.

In addition to being attached to the underside of the folding seat 102 of a chair 100, the storage device 10 of the present invention is capable of being attached to other positions on the chair 100, such as the back 104 (FIG. 11) or the side 106 (FIG. 12).

A third preferred embodiment of the storage device 10 is shown in FIG. 7. In this embodiment, a pocket 70 is attached by conventional means to the bottom 36 of the receptacle 30. The pocket 70 is preferably made of a clear material such as a plastic so that an advertisement inserted into the pocket 70 can be easily read when the folding seat 102 is in an upright position. In addition to advertisements, other marketing materials, for example, coupons, can be placed in the pocket 70.

The above disclosure sets forth a number of embodiments of the present invention. Other arrangements or embodiments, not precisely set forth, could be practiced under the teachings of the present invention and as set forth in the following claims.

We claim:

1. A storage device for attachment to a seat, said storage device comprising:

a frame with a first part adapted to be proximal to a seat and a second part adapted to be distal to a seat, one of said first and second parts having a plurality of sockets placed therein;

a receptacle with side edges, said side edges having spaces therein; and a plurality of detents extending from the other of said first and second parts of said frame and through said spaces in said side edges of said receptacle into said plurality of sockets, said detents releasably securing said first part of said frame to said second part of said frame and attaching said receptacle to said frame.

2. The storage device of claim 1, wherein said receptacle is made of a flexible material.

3. The storage device of claim 1 further comprising a plurality of pegs extending from one of said first and second parts of said frame through said spaces in said side edges of said receptacle and into said plurality of sockets in the other of said first and second parts of said frame.

4. The storage device of claim 1 wherein said first part and said second part are U-shaped.

5. The storage device of claim 1, further comprising a pocket attached to said receptacle.

6. The storage device of claim 5, wherein said receptacle is made of a flexible material.

7. The storage device of claim 5, wherein said first part and said second part of said frame are U-shaped.

8. The storage device of claim 5, further comprising a pocket attached to said receptacle.

9. A storage device for attachment to a seat, said storage device comprising:

a frame with a first part adapted to be proximal to a seat and a second part adapted to be distal to a seat, said first part and said second part having a plurality of holes placed therein, one of said first and second parts further having a plurality of sockets placed therein;

a receptacle with side edges, said side edges having spaces therein;

a plurality of pegs extending from the other of said first and second parts of said frame, said pegs being inserted through said spaces in said side edges of said receptacle into said plurality of sockets; and a plurality of connectors extending through said plurality of holes in said first part and said second part of said frame and extending through said spaces in said side edges of said receptacle, said connectors releasably securing said first part of said frame to said second part of said frame and also affixing said receptacle to said frame.

10. A storage device for attachment to a seat, said storage device comprising:

a frame with a first part adapted to be proximal to a seat and a second part adapted to be distal to a seat, said first part and said second part having a plurality of holes therein, one of said first and second parts further having a plurality of sockets therein;

a receptacle with side edges, said side edges having spaces therein;

a plurality of pegs extending from the other of said parts of said frame, said pegs extending through said spaces in said side edge of said receptacle and into said plurality of sockets;

a plurality of connectors extending through said plurality of holes in said first part and said second part of said frame and extending through said spaces in said side edges of said receptacle, said connectors releasably securing said first part of said frame to said second part of said frame and also affixing said receptacle to said frame; and a pocket attached to said receptacle.

11. The storage device of claim 10, wherein said first part and said second part are U-shaped.

12. A storage device for attachment to a seat, said storage device comprising:

a frame with a first part adapted to be proximal to a seat and a second part adopted to be distal to a seat, one of said first and second parts having a plurality of sockets placed therein;

a receptacle with side edges, said side edges having spaces therein, said receptacle being made of a flexible material;

a plurality of detents extending from the other of said first and second parts of said frame and through said spaces in said side edges of said receptacle into said plurality of sockets, said detents releasably securing said first part of said frame to said second part of said frame and attaching said receptacle to said frame; and a plurality of pegs extending from one of said first and second parts of said frame through said spaces in said side edges of said receptacle and into said plurality of sockets in the other of said first and second parts of said frame.

* * * * *

UNITED STATES PATENT AND TRADEMARK OFFICE

CERTIFICATE OF CORRECTION

PATENT NO. : 5,820,210

DATED : Oct. 13, 1998

INVENTOR(S) : Shipman et al.

It is certified that error appears in the above-indentified patent and that said Letters Patent is hereby corrected as shown below:

column 1, line 32, insert --and-- before "may"
column 3, line 31, replace "ad" with --ad.--
column 6, line 4, insert --10-- after "device"
column 6, line 53, insert --40*b*-- after "holes"
column 7, line 26, delete "56" and insert therefor --54--
column 8, line 42, replace "6. The storage device of claim 5," with --7. The storage device of claim 6,--
column 8, line 44, replace "7. The storage device of claim 5," with --8. The storage device of claim 6,--
column 8, line 46, replace "8. The storage device of claim 5," with --9. The storage device of claim 6,--
column 8, line 48, replace "9. A storage device" with --6. A storage device--
column 10, line 4, replace "adopted" with --adapted--

Signed and Sealed this

Fourth Day of May, 1999

*Attest:*

*Attesting Officer*

Q. TODD DICKINSON

*Acting Commissioner of Patents and Trademarks*